United States Patent [19]

Takada

[11] Patent Number: 4,714,364

[45] Date of Patent: Dec. 22, 1987

[54] AUTOMATICALLY RETURNED PAPER BALL ASSEMBLY OF A PRINTER

[75] Inventor: Hiromi Takada, Yokohama, Japan

[73] Assignee: Ricoh Company, Ltd., Tokyo, Japan

[21] Appl. No.: 764,239

[22] Filed: Aug. 9, 1985

[30] Foreign Application Priority Data

Aug. 10, 1984 [JP] Japan ..... 59-166584
Aug. 10, 1984 [JP] Japan ..... 59-166585

[51] Int. Cl.[4] ..... B41J 13/20

[52] U.S. Cl. ..... 400/639.1; 400/550; 400/551

[58] Field of Search ..... 400/550, 551, 624, 625, 400/629, 637.1, 639, 639.1, 639.2, 640, 708, 708.1

[56] References Cited

U.S. PATENT DOCUMENTS

| | | | |
|---|---|---|---|
| 4,031,995 | 6/1977 | Blum et al. | 400/550 X |
| 4,211,499 | 7/1980 | Hunt et al. | 400/639.1 X |
| 4,469,454 | 9/1984 | Crean | 400/639.1 X |
| 4,486,108 | 12/1984 | Tanaka | 400/637.1 X |
| 4,498,795 | 2/1985 | Tatara | 400/550 X |
| 4,525,089 | 6/1985 | Falconieri | 400/640 X |

FOREIGN PATENT DOCUMENTS

| | | | |
|---|---|---|---|
| 0162677 | 12/1981 | Japan | 400/639.1 |
| 0084885 | 5/1982 | Japan | 400/639.1 |
| 0107873 | 7/1982 | Japan | 400/639.1 |
| 0111876 | 6/1984 | Japan | 400/639 |

OTHER PUBLICATIONS

IBM Technical Disclosure Bulletin, "Paper Feed Apparatus", Garrison et al., vol. 22, No. 4, Sep. 1979, pp. 1321-1322.

IBM Technical Disclosure Bulletin, "Automatic First Writing Line Mechanism", Sweat, Jr., vol. 23, No. 19, Feb. 1981, pp. 3961-3964.

IBM Technical Disclosure Bulletin, "Damped Bail Closing", Kroeker, vol. 27, No. 18, Jun. 1984, pp. 601-602.

*Primary Examiner*—Ernest T. Wright, Jr.

*Attorney, Agent, or Firm*—Cooper, Dunham, Griffin & Moran

[57] ABSTRACT

A paper setting mechanism of a printer for setting a sheet of paper in position around a platen roller for printing desired information includes a paper bail assembly having at least one bail roller, which is pivotally supported and normally biased so as to cause the bail roller to be pressed against the platen roller. The paper bail assembly may be set in a set position in which the bail roller is pressed against the platen roller and it may also be set in a retracted position in which the bail roller is separated away from the platen roller. After insertion of paper, the platen roller is driven to rotate first in the normal direction over a first predetermined amount and then in the reversed direction over a second predetermined amount, which is smaller than the first predetermined amount, whereby the reversed rotation of the platen roller is utilized to cause the paper bail assembly to return to its set position automatically.

7 Claims, 22 Drawing Figures

AUTOMATICALLY RETURNED PAPER BALL ASSEMBLY OF A PRINTER

BACKGROUND OF THE INVENTION

1. Field of the Invention

This invention generally relates to a printer and in particular to a paper setting mechanism of a printer for setting a sheet of paper around a platen roller to be ready for printing. More specifically, the present invention relates to a mechanism for controlling the position of a paper bail assembly for keeping a sheet of paper pressed against the platen roller of a printer.

2. Description of the Prior Art

In general, in various types of printers, including type wheel printers, thermal printers, thermal transfer printers, dot-impact printers and electronic typewriters, when a sheet of paper is to be set in position, a paper bail assembly is moved to its retracted position separated away from a platen roller thereby allowing a sheet of paper to be set in position as placed around the platen roller, and, then, the paper bail assembly must be moved back to its set position where the bail rollers of the paper bail assembly are pressed against the platen roller with the sheet of paper sandwiched therebetween.

Thus, in such a prior art paper setting mechanism of a printer, the paper bail assembly is, for example, pulled manually in a predetermined direction so as to be temporarily retained at its retracted position where the bail rollers are separated away from the platen roller, and, after placing a sheet of paper around the platen roller, the paper bail assembly is further pulled in the predetermined direction to have a microswitch or the like activated thereby causing the platen roller to rotate over a predetermined amount in the normal direction whereby the sheet of paper placed around the platen roller is set in position, which is followed by the step of manually moving the paper bail assembly to the opposite direction to release the restrained condition of the paper bail assembly thereby causing the bail rollers to be pressed against the platen roller with the sheet of paper sandwiched therebetween to complete the paper setting operation. However, such a prior art paper setting mechanism is poor in operability because the paper bail assembly must be operated manually not only when a sheet of paper is to be inserted but also when the bail rollers are to be brought back to the set condition to be pressed against the platen roller.

SUMMARY OF THE INVENTION

In accordance with the principle of the present invention, there is provided a structure for controlling the position of a paper bail assembly of a printer in which the paper bail assembly normally pressed against a platen roller may be moved to and temporarily held at a retracted position separated away from the platen roller and then, after insertion of a sheet of paper, the platen roller is driven to rotate first in the normal direction and then in the reversed direction thereby causing the paper bail assembly to move back to its set position to be pressed against the platen roller automatically. In the preferred embodiment of the present invention, the paper bail assembly has two retracted positions, wherein when the paper bail assembly is moved to its first retracted position separated away from the platen roller, there is formed a gap between the bail rollers and the platen roller thereby allowing to have a sheet of paper inserted, and then when the paper bail assembly is moved to its second retracted position further separated away from the platen roller, a switch is actuated by this further movement of the paper bail assembly so that the platen roller is driven first to rotate in the normal direction over a first predetermined amount and then to rotate in the reversed direction over a second predetermined amount, whereby the reversed rotation of the platen roller is utilized to move the paper bail roller back to its set position where its bail rollers are pressed against the platen roller.

It is therefore a primary object of the present invention to obviate the disadvantages of the prior art as described above and to provide an improved paper setting mechanism of a printer.

Another object of the present invention is to provide an improved paper setting mechanism of a printer which is capable of insuring its paper bail rollers to be brought back to the set position automatically whenever a sheet of paper is set in position ready for printing.

A still further object of the present invention is to provide an improved paper setting mechanism of a printer which is enhanced in operability and reliable in operation.

Other objects, advantages and novel features of the present invention will become apparent from the following detailed description of the invention when considered in conjunction with the accompanying drawings.

DESCRIPTION OF THE PREFERRED EMBODIMENTS

Figure 1:
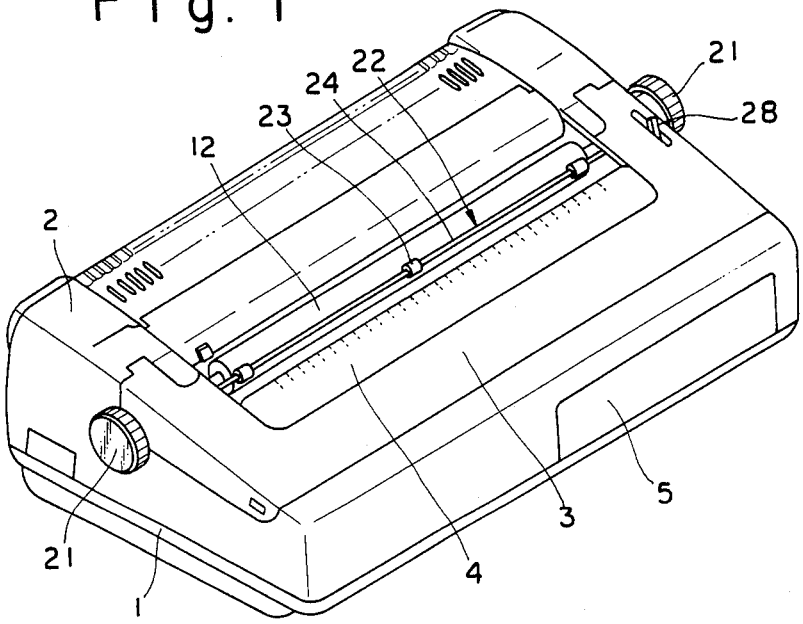
FIG. 1 is a perspective view showing the overall outlook of a printer to which the present invention has been advantageously applied.

Referring now to FIG. 1, there is shown in perpspective a type wheel printer which has been constructed in accordance with one embodiment of the present invention. As shown, the printer includes a bottom case 1 and an upper case 2 which together define an outside housing for enclosing therein various mechanical and electrical parts. The printer also includes a cover 3 which is pivotally supported so as to be pivoted open for replacement of type wheels and/or ribbon cassettes and which is provided with a character scale 4. The upper case 2 is provided with a control panel 5 at its front end, where various switches, such as an on line/off line switch, a line feed switch and a margin set switch, and indicators, such as a ribbon end indicator and a power on indicator, are arranged, though they are not specifically shown in FIG. 1.

Figure 2:
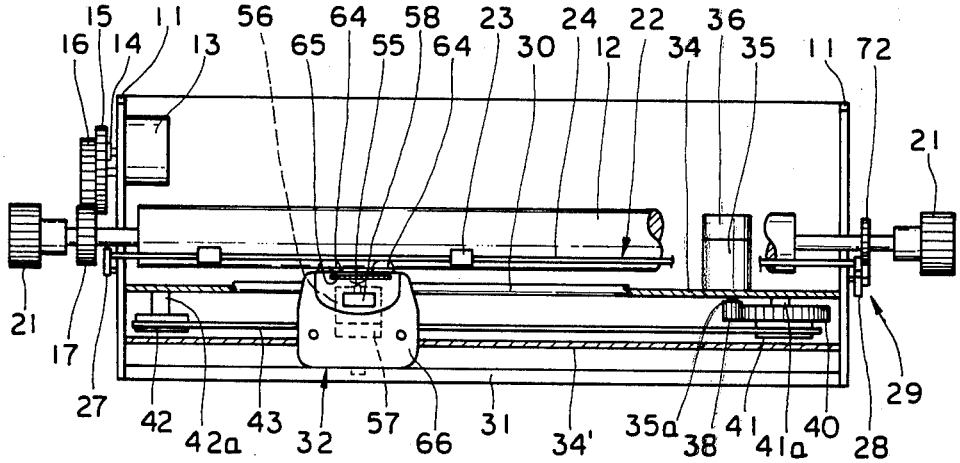
FIG. 2 is a schematic plan view of the printer shown in FIG. 1.
Figure 3:
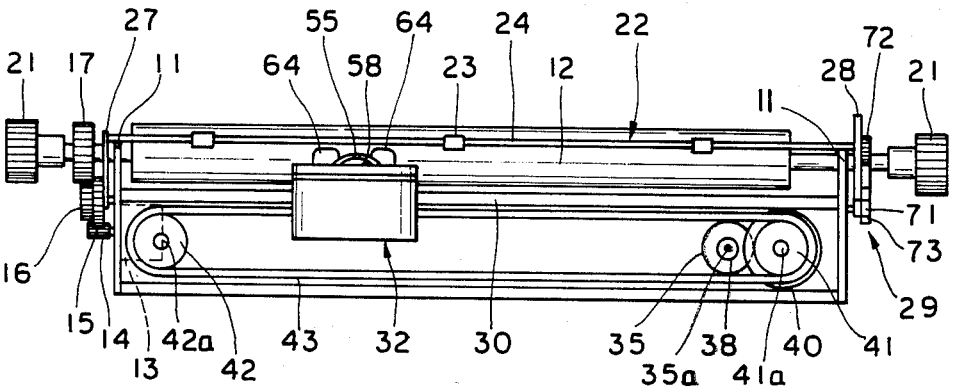
FIG. 3 is a schematic front view of the printer shown in FIG. 1.

FIGS. 2 and 3 schematically show the overall mechanical structure of the printer in plan view and front view, respectively. As shown, the printer includes a platen 12, for guiding the advancement of a sheet of paper 12*p* (see FIG. 6) rotatably supported between a pair of side frames 11, 11. The platen roller 12 is driven to rotate by means of a line feed motor 13 which is comprised of a stepping motor and fixedly mounted on the left-hand side frame 11 through a power transmission train comprised of a motor gear 14, an idle gear 15, another idle gear 16 which rotates together with the idle gear 15, and a platen gear 17. Thus, when the platen roller 12 is driven to rotate in the normal direction by means of the line feed motor 13, the sheet of paper 12*p* placed around the platen roller 12 is caused to advance in the line feed direction.

Figure 4:
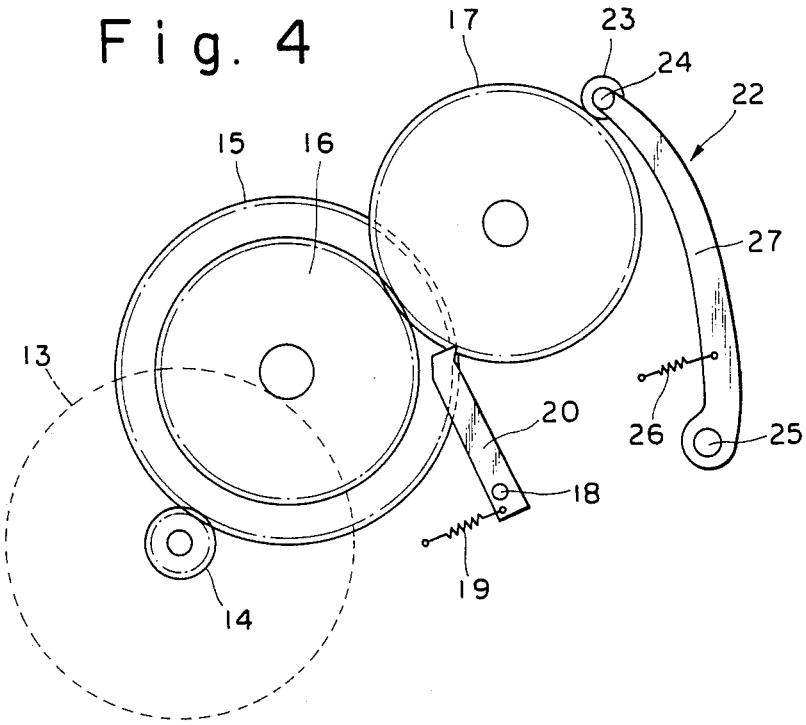
FIG. 4 is a schematic side elevational view of the printer shown in FIG. 1.

As shown in FIG. 4, there is provided a detent lever 20 whose base end is pivotally supported by a shaft 18 and connected to one end of a spring 19 so as to have its free end engaged with the platen gear 17 thereby allowing to prevent an error in paper feed from occurring due to backlash between gears 14–17. A knob 21 is fixedly mounted at each end of the platen 12, so that the platen 12 may be rotated manually by grabbing at least either one of these knobs 21, 21 when removing the sheet of paper 12*p*.

Generally in front of the platen roller 12 is disposed a paper ball assembly 22 pivotally supported and spring-biased toward the platen roller 12. As best shown in FIG. 4, the paper bail assembly 22 includes a plurality of bail rollers 23 which are spaced apart from one another, a bail rod 24 extending in parallel with the platen roller 12 for rotatably supporting the bail rollers 23, a pair of bail levers 27 and 28 which are located on both ends of the platen roller 12 to support the both ends of the bail rod 24 at their forward ends, a support shaft 25 for pivotally supporting the pair of bail levers 27 and 28 and a tension coil spring 26 for biasing the bail rollers 23 to be pressed against the platen roller 12. Thus, the bail rollers 23 are normally pressed against the platen roller 12 under the force of the spring 26, but the bail rollers 23, or the paper bail assembly 22 for that matter, may be moved away from the platen roller 12 against the recovery force of the spring 26, so that the paper bail assembly 22 may be located at a set position where the bail rollers 23 are pressed against the platen roller 12 and at a retracted position where the bail rollers 23 are separated away from the platen roller 12. It is to be noted that at the side of the bail lever 28 there is provided a paper set mechanism 29 for latching or unlatching the paper bail assembly 22 in the retracted position, and its structure will be described in detail later.

On the other hand, a pair of guide rods 30 and 31 is provided in parallel as fixedly attached to the side frames 11, 11 and extending in parallel with the platen roller 12. A carriage 32 is mounted on the pair of guide rods 30, 31 so as to be reciprocatingly movable therealong so that the carriage 23 moves along the platen roller 12 back and forth. The detailed structure of the carriage 32 will be given later.

A subframe 34 is provided extending between the side frames 11, 11 and a space motor 35 comprised of a d.c. motor is fixedly mounted on the subframe 34. The space motor 35 is provided with a photoencoder (space sensor, not shown) for detecting the rotation of a rotary shaft 35*a* of the space motor 35. Another subframe 34' is provided as spaced apart from and extending in parallel with the subframe 34. And, on both ends of the pair of subframes 34, 34', there are provided guide pulleys 41 and 42. The guide pulley 41 is integrally formed with a gear 40, which is in mesh with a pinion gear 38 fixedly mounted on a rotary shaft 35*a* of the space motor 35, and has a shaft 41*a* which is rotatably supported between the subframes 34 and 34'. The other guide pulley 42 has a shaft 42*a* which is also rotatably supported between the subframes 34 and 34'.

Also provided extending between the pair of guide pulleys 41 and 42 is a space wire 43 which has its both ends fixedly attached to opposite sides of the carriage 32, so that the carriage 32 may be moved along and in parallel with the platen roller 12 in a reciprocating manner by means of the space motor 35.

Figure 5:
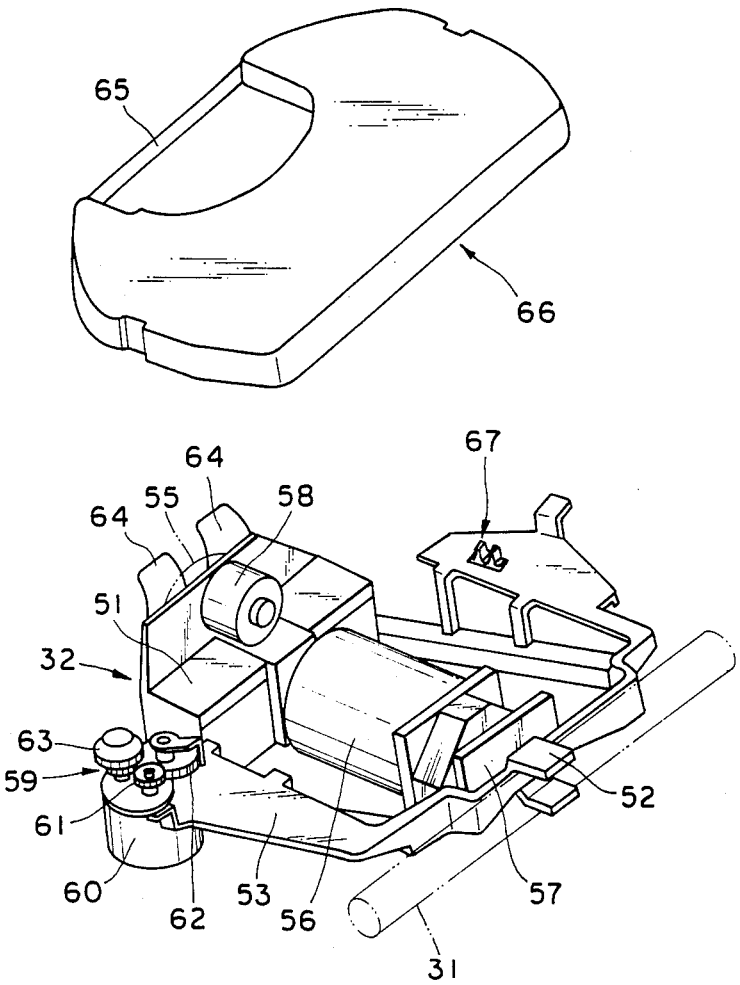
FIG. 5 is a schematic perspective view showing on an enlarged scale the carriage of the printer shown in FIG. 1 and an ink ribbon cartridge to be detachably mounted on the carriage.

Now, with particular reference to FIG. 5, the structure of carriage 32 will be described in detail below. The carriage 32 generally includes a carriage block 51, which slidably rides on the guide rod 30, and a carrier frame 53 which is integrally provided with the carriage block 51 and which has a guide 52 engageable with the guide rod 31 at its rear end. It is to be noted that such details are not shown in FIGS. 3 and 4 for the sake of brevity. On the inegrated structure of carriage block 51 and carrier frame 53 are mounted various elements, such as a selection motor 56 comprised of a d.c. motor provided with a type wheel 55, a photoencoder (selection sensor) 57 for detecting the rotation of the selection motor 56, a printing hammer 58 for impacting a selected type of the type wheel 55 and a ribbon feed mechanism 59 for feeding ink ribbon 65. The ribbon feed mechanism 59 includes a ribbon feed motor 60, a drive gear 61, a feed gear 62 and a feed knob 63.

A pair of paper guides 64, 64 is mounted at the front end of the carriage block 51 of carriage 32 located spaced apart from the platen roller 12. The paper guides 64, 64 are shaped to generally comply with the shape of the platen roller 12 so as to properly guide the advancement of a sheet of paper 12*p*. Also on the carriage frame 53 of carriage 32 is mounted a ribbon end sensor 67 which is comprised of a light-transmission type photosensor and which becomes inserted into a ribbon cassette 66, when the cassette 66 housing therein a quantity of ink ribbon 65 is set in position, for detecting the end of the ink ribbon 65.

Figure 6:
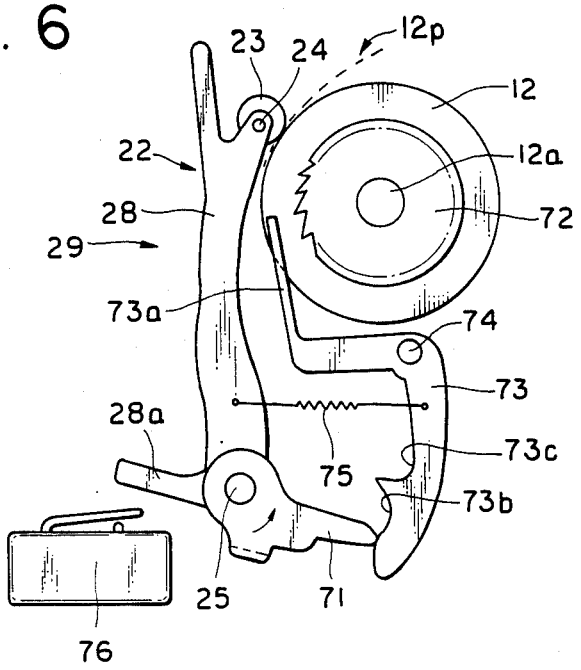
FIG. 6 is a schematic illustration showing the paper setting mechanism provided in the printer shown in FIG. 1.

Referring now to FIG. 6, the structure of the paper setting mechanism 29 will be described in detail. It is to be noted that, with respect to the paper setting mechanism 29, FIG. 6 shows a set condition in which the bail rollers 23 of the paper bail assembly 22 are pressed against the platen roller 12. In the illustrated paper setting mechanism 29, the bail lever 28 is provided with a lever 71 which move together with the bail lever 28. On the other hand, the platen roller 12 is mounted on a shaft 12*a* to which is fixedly attached a reset ratchet wheel 72. Also provided generally disposed below the platen roller 12 is a latch lever 73 pivotally supported by a shaft 74. The latch lever 73 has an arm portion 73*a* engageable with the reset ratchet wheel 72 and is formed with first and second engaging portions 73*b* and 73*c* which are engageable with the lever 71. The latch lever 73 is operatively connected to the bail lever 28 through a tension coil spring 75. Integrally formed at the rear end of the bail lever 28 is a switch arm 28*a* which may be brought into contact with an auto set switch 76 comprised of a micro switch for actuation thereof. As will be made clear later, the auto set switch 76 is actuated by the switch arm 28*a* when the bail lever 28 has been pivoted to a predetermined position.

Figure 7:
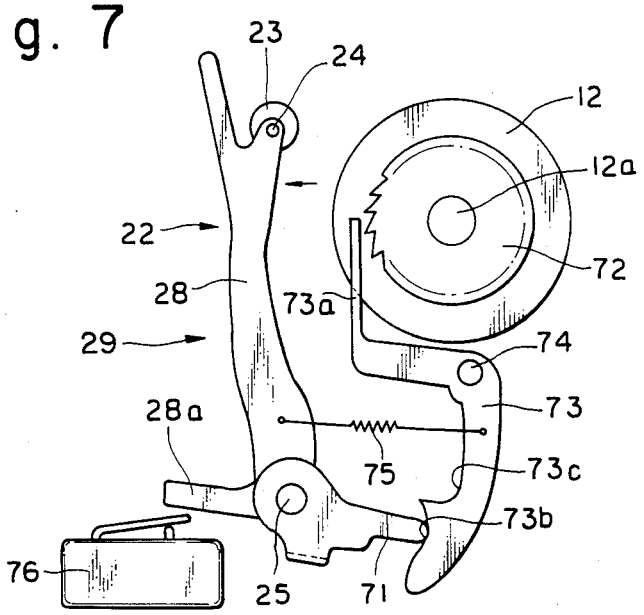
FIGS. 7 through 9 are schematic illustrations which are useful for explaining the operation of the paper setting mechanism shown in FIG. 6.

The operation of the paper setting mechanism 29 shown in FIG. 6 will be described in detail with reference to FIGS. 7 through 9 later.

Figure 10:
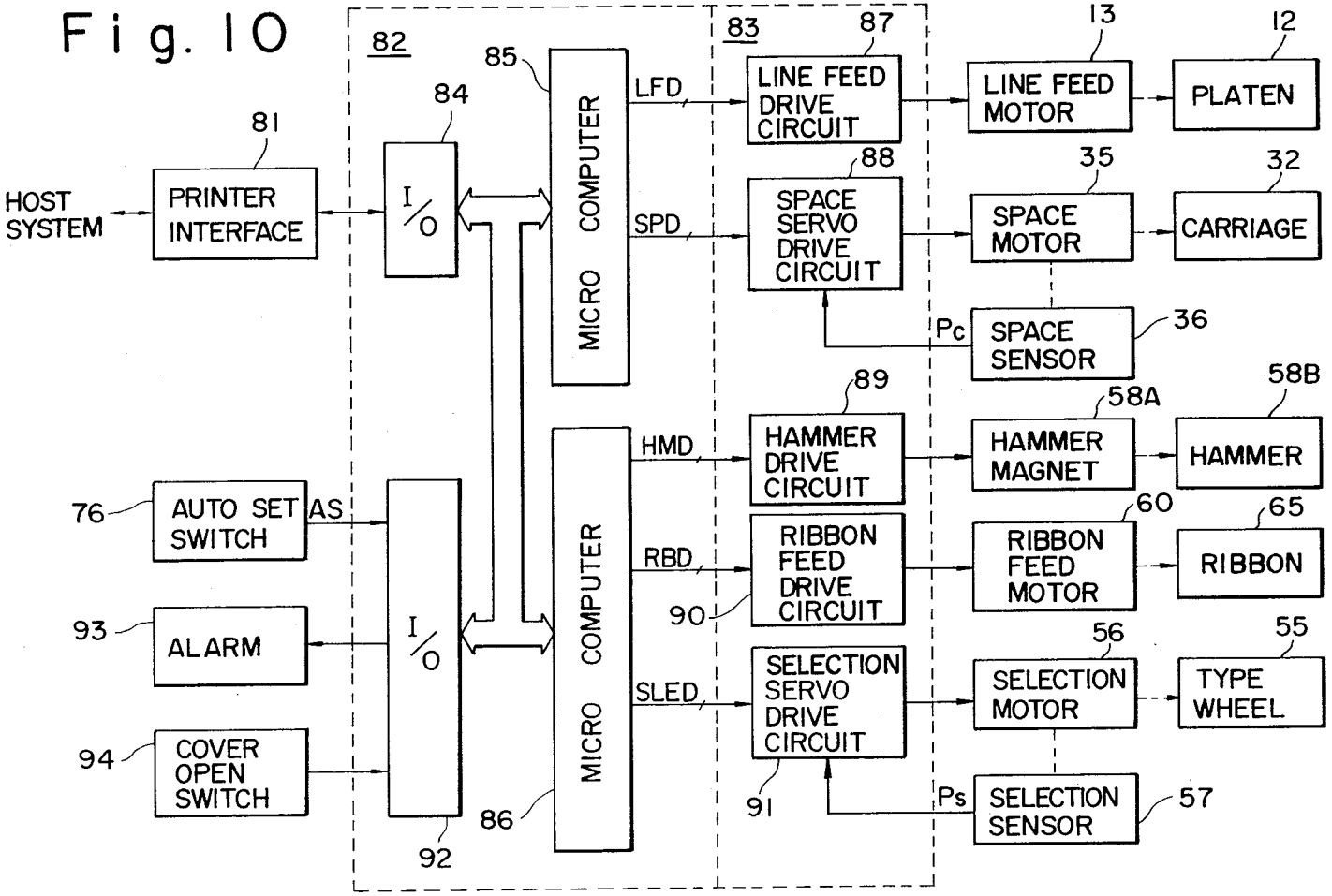
FIG. 10 is a block diagram showing a print control system provided in the printer of FIG. 1.

FIG. 10 shows in block form the print control system of this printer. As shown, the print control system generally includes a printer interface 81 for receiving various data from a host system, a printer control circuit 82 which handles the overall control of this printer and which also serves as paper setting control means, and a driver circuit 83 containing various driver circuits. The printer interface 81 is, for example, comprised of Centronix parallel interface or RS232C serial interface, and it receives various data, such as character code data, space (amount of carriage movement) data and line feed data, as supplied from the host system. The printer control circuit 82 includes an I/O unit 84, which receives data from the printer interface 81, and a pair of microcomputers 85 and 86 which supply various signals for controlling the operation of various parts of the printer. As is obvious for one skilled in the art, the microcomputer 85 is comprised of various electronics elements, such as a CPU, ROM, RAM and I/O unit, and it has a role of controlling the line feed operation (advancement of paper 12*p*) and the space operation (carriage movement) among various operations of the printer.

For this reason, the micrcomputer 85 supplies a line feed drive data LFD to a line feed drive circuit 87 to drive under control the line feed motor 13 thereby causing to rotate the platen roller 12 under control, and, therefore, in this manner, line feed and back line feed operations are properly controlled. The microcomputer 85 also supplies a space drive data SPD, which designates the amount of rotation of space motor 35 and its direction of rotation corresponding to the amount of movement of carriage 32, to a space servo drive circuit 88 so as to drive the space motor 35 thereby causing to carry out the space operation to move the carriage 32 over a predetermined distance in a desired direction. The space servo drive circuit 88 receives space drive data SPD from the microcomputer 85 and position signal Pc from space sensor 36 and then drives the space motor 35 under control based on this information thus received.

On the other hand, the microcomputer 86 is in charge of other control operations than the line feed and space operations among various control operations of the printer, and, thus, it handles the printing and ribbon feed control operations, for example. Accordingly, the microcomputer 86 supplies a hammer drive data HMD to a hammer drive circuit 89 so as to control the operation of a hammer magnet 58A constituting a printing hammer 58 thereby causing a hammer 58B to impact a selected type of type wheel 55. Furthermore, the micrcomputer 86 supplies a ribbon feed drive data RBD to a ribbon feed drive circuit 90 so as to control the operation of a ribbon feed motor 60 thereby causing the ink ribbon 65 of ribbon cassette 66 to be fed. The microcomputer 86 also supplies a selection drive data SLED, which designates the amount and direction of rotation of the selection motor 56 corresponding to the amount of rotation of type wheel 55, to the selection servo drive circuit 91 thereby causing to rotate the selection motor 56 under control to have the type wheel 55 rotated over a desired amount in a desired direction thereby locating a desired type of type wheel 55 at a printing position where impacted by the printing hammer 58.

The selection servo drive circuit 91 receives the selection drive data SLED from the microcomputer 86 and the position signal Ps from the selection sensor 57 and drives under control the selection motor 56 based on this information. Furthermore, the microcomputer 85 of printer control circuit 82 receives an auto set designating signal from an auto set switch 76 through an I/O unit 92 and, based on this signal, drives the line feed motor 13 under control to rotate the platen roller 12 in the normal or reversed direction. At the same time, the microcomputer 85 determines as to the presence or absence of paper setting error, and if the occurrence of error has been detected, an alarm 93 is activated through the I/O unit 92 to apprise the operator of this fact. In addition, the printer control circuit 82 also receives a status signal of a cover open switch 94 for detecting the open or closed condition of the cover 3 shown in FIG. 1 through the I/O unit 92 and it carries out a processing, for example, to stop the printing operation when the cover 3 is detected to be open.

Next, the paper setting operation of the printer as described above will be described in detail below. In the first place, the operation of the paper setting mechanism 29 of this printer will be described in detail with reference to FIGS. 6 through 9.

In the present paper setting mechanism 29, when the paper bail assembly 22 is in its set position with the bail rollers 23 pressed against the platen roller 12, the forward end of the lever 71 is in engagement with a surface portion of the latch lever 73 other than the first and second engaging portions 73*b* and 73*c*, as shown in FIG. 6, and the arm portion 73*a* of the latch lever 73 is disengaged from the reset ratchet wheel 72. Under this condition, if the bail lever 28 is grabbed and pivoted to move away from the platen roller 12 so as to locate the paper bail assembly 22 in its first retracted position as shown in FIG. 7, the lever 71 comes to be engaged with the first engaging portion 73*b* of the latch lever 73 so that the paper bail assembly 22 is maintained in the first retracted position. Under these circumstances, the latch lever 73 still remains disengaged from the reset ratchet wheel 72 and the auto set switch 76 means unactuated. When the paper bail assembly 22 is set in the first retracted position, the bail rollers 23 are moved away from the platen roller 12 so that a sheet of paper 12*p* may be inserted and corrected in skew, if necessary, but no automatic paper setting operation is carried out.

Figure 8:
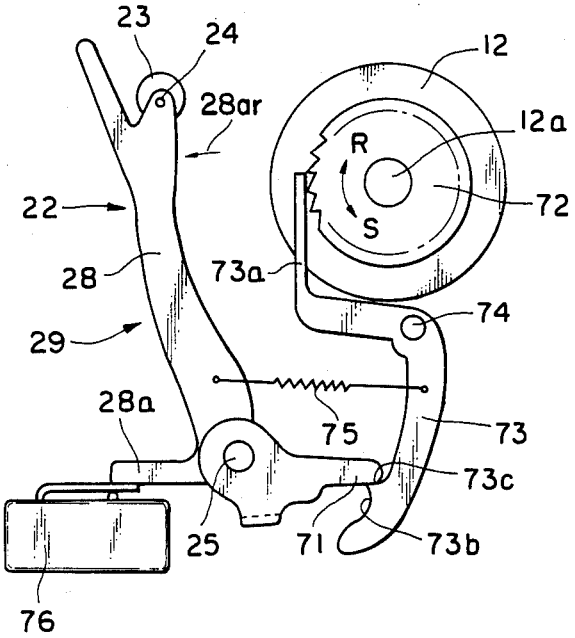
Figure 9:
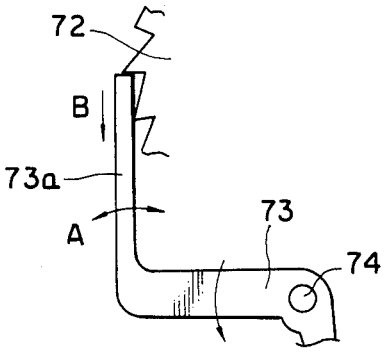

Then, if the bail lever 28 is further pivoted counterclockwise as indicated by the arrow 28*ar* in FIG. 8, the lever 71 now comes to be engaged with the second engaging portion 73*c* of the latch lever 73 so that the paper bail assembly 22 comes to be latched into a second retracted position, and, at the same time, the forward end of the arm portion 73*a* of the latch lever 73 becomes engaged with the reset ratchet wheel 72. Under this condition, the auto set switch 76 is actuated by the switch arm 28*a* of the bail lever 28 so that an auto set designating signal AS is supplied to the printer control circuit 82. Then, as will be described further in detail later, the microcomputer 85 of the printer control circuit 82 drives under control the line feed motor 13 thereby causing to rotate the platen roller 12 in the normal direction (line feed direction) or the direction indicated by the arrow R in FIG. 8 so as to execute the rotation of the platen roller 12 over the amount corresponding to a sum of a first predetermined amount X and a second predetermined amount N, which is followed by the step of rotating the platen roller 12 in the reversed direction (back line feed direction) or in the direction indicated by the arrow S in FIG. 8 over the second predetermined amount N.

It is to be noted that since the reset ratchet wheel 72 is fixedly attached to the shaft 12*a* of platen roller 12, it rotates together with the platen roller 12. Accordingly, when the reset ratchet wheel 72 rotates in the normal direction (direction indicated by arrow R), the latch lever 73 pivots back and forth only slightly as indicated by the double-headed arrow A in FIG. 9 because the reset ratchet wheel 72 is in engagement with the arm portion 73*a* of the latch lever 73. On the other hand, when the reset ratchet wheel 72 rotates in the reversed direction (direction indicated by arrow S), the latch lever 73 temporarily follows the rotation of the wheel 72 so that it pivots counterclockwise around the shaft 74 thereby moving the arm portion 73*a* downward as indicated by the arrow B. As a result, the lever 71 becomes disengaged from the second engaging portion of the latch lever 73, which then causes the bail lever 28 to pivot clockwise due to the recovery force of the bail lever spring 26 thereby bringing the bail lever 28 back to its original set position with the bail rollers 23 again pressed against the platen roller 12.

Next, referring to FIG. 11, the paper setting control processing executed by the printer control circuit 82 will be described.

Figure 11:
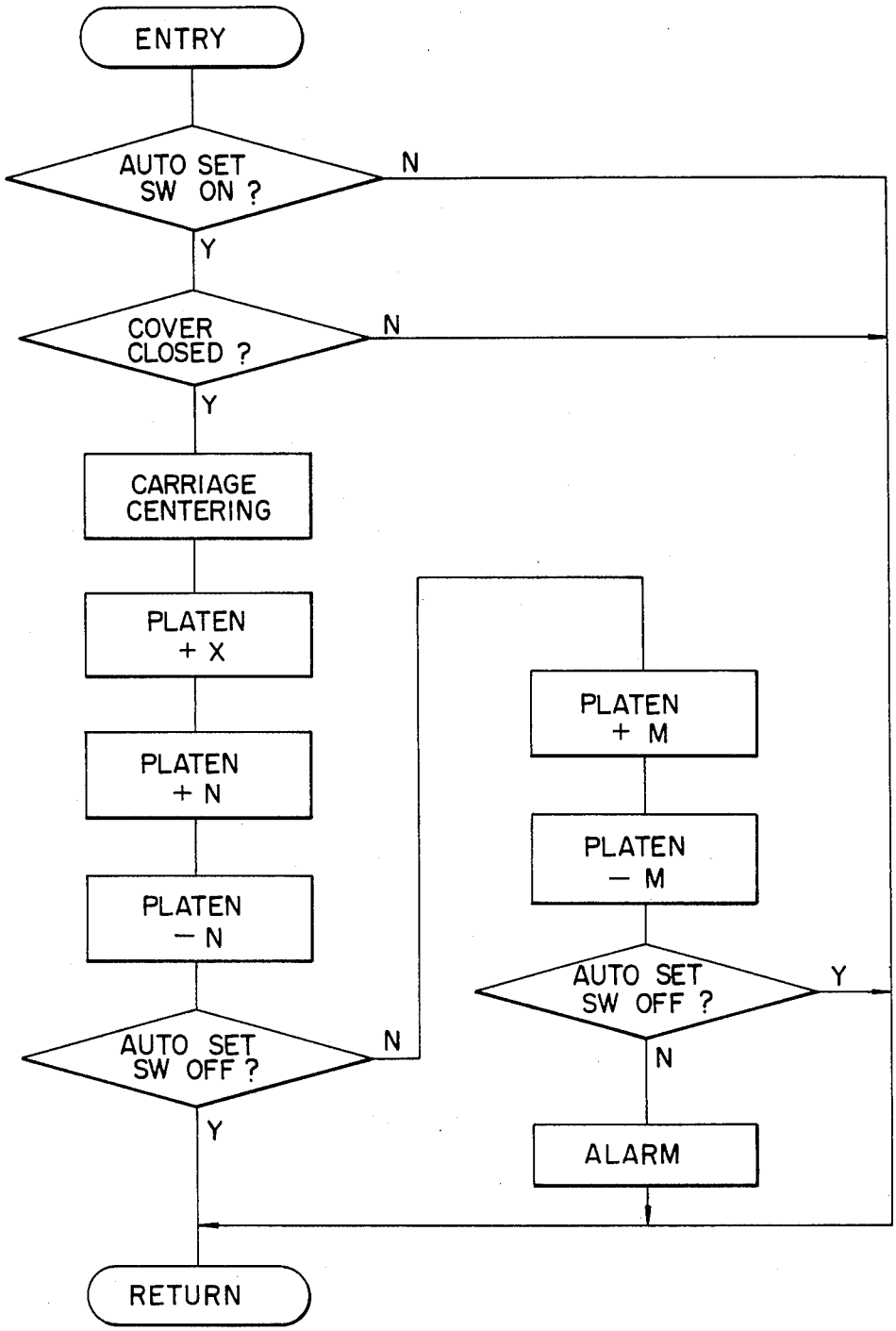
FIG. 11 is a flow chart showing a sequence of steps which are followed when carrying out the paper setting operation in accordance with the print control system of FIG. 10.

As shown in the flow chart shown in FIG. 11, it is determined as to whether the auto set switch 76 has been turned on (actuated) or not. If the auto set switch 76 has been determined to be turned on, then the status signal from the cover open switch 94 is examined to determine as to whether the cover 3 is closed or not. If the cover 3 has been found to be closed, a carriage centering operation is carried out to bring the carriage 32 to a position which is determined to be a center between the left and right margins which are set, for example, by the information supplied from the host system or by switches provided in the printer itself, or, alternatively, at an approximate center position of the platen roller 12 if the left and right margins are not set. Such a carriage centering processing is implemented in order to secure the proper insertion of a sheet of paper 12*p* by advantageously utilizing the pair of paper guides 64, 64 mounted on the carriage 32 at the central position.

Thereafter, the platen roller 12 is driven to rotate over the first predetermined amount X in the normal direction (line feed direction) to feed a sheet of paper 12*p* to a predetermined set position, and, then, the platen roller 12 is further driven to rotate in the normal direction over the second predetermined amount N, which is followed by the step of causing the platen roller 12 to be driven to rotate in the reversed direction (back line feed direction) over the second predetermined amount N to bring the sheet of paper 12*p* to be again located in its normal set position. With such a back and forth rotation of the platen roller 12 over the second predetermined amount N, the paper bail assembly 22 of the present paper setting mechanism 29 is released from the latched condition.

Then, as indicated in the flow chart of FIG. 11, it is determined as to whether the auto set switch 76 is in off state or not. This step of operation is provided so as to determine as to whether the paper bail assembly 22 is properly returned to its set condition or not. That is, if it is determined that the auto set switch 76 is its off state, the paper bail assembly 22 may be presumed to have returned to its original set position so that the process now can go back to the main routine. On the other hand, if the auto set switch 76 is found to be in its on state, then it may be presumed that the paper bail assembly 22 has not properly returned to its original set position due to some abnormality, so that the process proceeds by driving to rotate the platen roller 12 first in the normal direction over a third predetermined amount M (M may be set eqaul to N) and then in the reversed direction over the third predetermined amount M. Thereafter, it is again determined as to whether the auto set switch 76 is in its off condition or not, and if it is still found to be in its off condition, then the alarm 93 is activated to apprise the operator of the occurrence of abnormality in the paper setting operation.

In this manner, in the present printer, the paper bail assembly 22 is first latched into a retracted position separated away from the platen roller 12, and then the platen roller 12 is driven to move first in the normal direction and then in the reversed direction, whereby the reversed rotation of the platen roller 12 is utilized to release the latched condition of the paper bail assembly 22 thereby allowing the paper bail assembly 22 to return to its original set condition where the bail rollers 23 of the paper bail assembly 22 are pressed against the platen roller 12. With such a structure, upon completion of the paper setting operation, the paper bail assembly 22 returns to its original set position automatically, the paper setting operation is greatly facilitated and the paper bail assembly 22 is always insured to take the set position upon completion of the paper setting operation.

Figure 12:
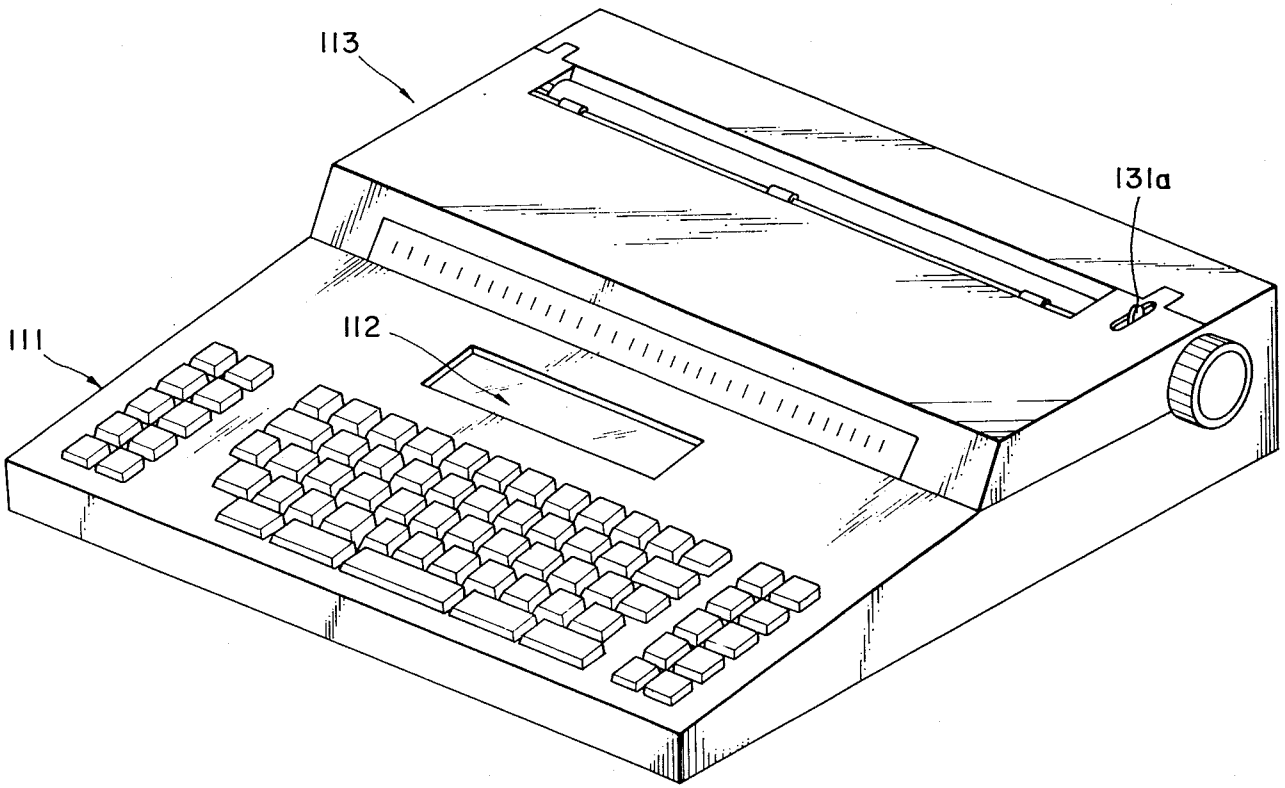
FIG. 12 is a perspective view showing the overall outlook of an electronic typewriter to which the present invention has been applied.
Figure 13:
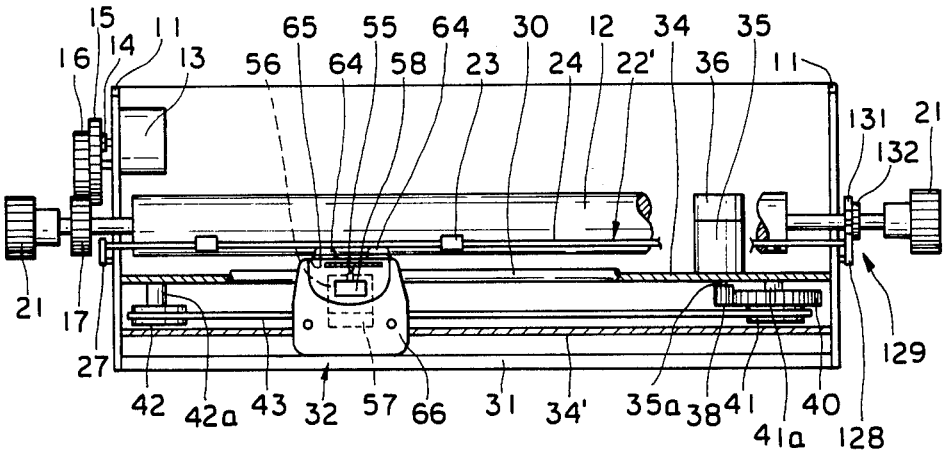
FIG. 13 is a schematic plan view of the typewriter shown in FIG. 12.
Figure 14:
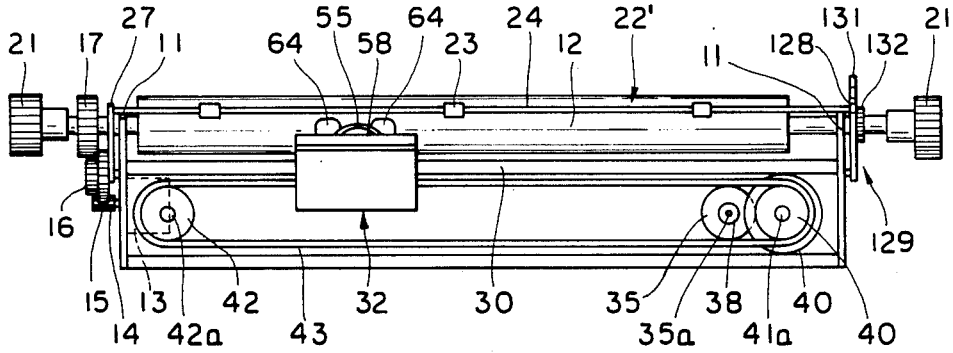
FIG. 14 is a schematic front view of the typewriter shown in FIG. 12.

FIG. 12 shows in perspective the overall outlock of an electronic typewriter which is constructed in accordance with another embodiment of the present invention. As illustrated, the present electronic typewriter includes a keyboard 111, through which graphic and character data necessary for composing or editing a text, various format data, such as left and right margins and tabs, and function data, such as correct designating data, are input, a line display 112 comprised, for example, of a liquid crystal display (LCD) or light-emitting diode (LED) display for displaying text in a predetermined number of lines and a printer 113 for printing a text or layout on a sheet or recording paper 12*p*. FIGS. 13 and 14 show the internal structure of the printer section 113 of the typewriter shown in FIG. 12 in plan view and front view, respectively. It is to be noted that the structure shown in FIGS. 13 and 14 is similar to the structure shown in FIGS. 3 and 4 of the previous embodiment in many respects so that like numerals indicate like elements. It will be understood that, in the present embodiment, a bail lever 128 and paper setting mechanism 129 are provided instead of the bail lever 28 and the paper setting mechanism 29 of the previous embodiment and the detect lever 20 in the line feed mechanism of the previous embodiment shown in FIG. 4 has been omitted in the present embodiment. It should further be noted that the carriage 32 of the present printer 113 is provided with a print correction mechanism which causes correction tape to be located at a printing position switchingly with the ink ribbon 65 for effecting erasure of incorrect imprints.

Figure 15:
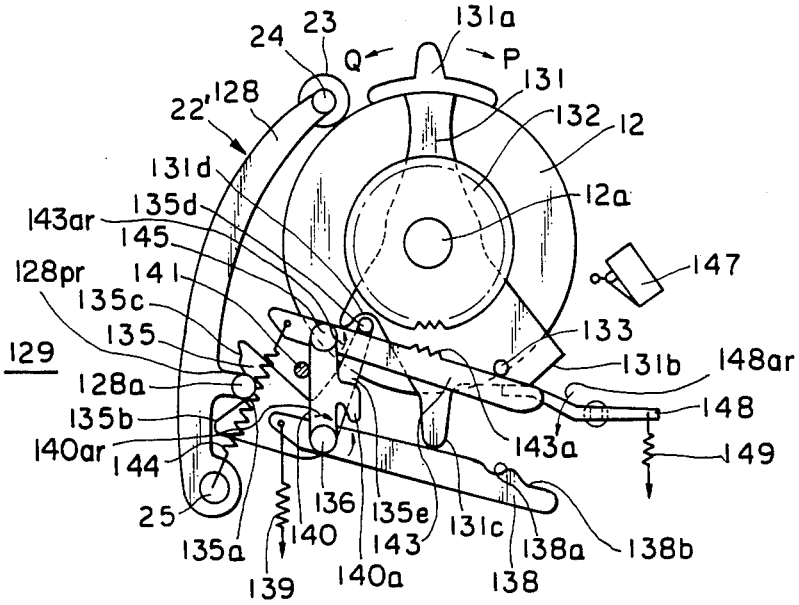
FIG. 15 is a schematic illustration showing a paper setting mechanism provided in the typewriter of FIG. 12.

FIG. 15 illustrates the detailed structure of the paper setting mechanism 129 provided in the printer 113 of the typewriter shown in FIG. 12. It is to be noted that the paper setting mechanism 129 is not fully disclosed in FIGS. 13 and 14 for the sake of brevity. It should further be noted that FIG. 15 shows the set condition of the paper setting mechanism 129 in which the bail rollers 23 of the paper bail assembly 22' are pressed against the platen roller 12.

As illustrated in FIG. 15, a set lever 131 having an integrally formed knob 131*a* is rotatably supported on the shaft 12*a* of platen roller 12 so that the set lever 131 may be rotated in either direction as indicated by arrow P for the clockwise direction and arrow Q for the counterclockwise direction. Also provided is a reset ratchet wheel 132 fixedly mounted on the shaft 12*a*. The set lever 131 includes a first cam portion 131*b*, a projection 131*c* and a second cam portion 131*d*, and it is provided with a stopper 133 as planted therein at a predetermined location thereof. Also provided is a bail set arm 135 which is supported to be pivotal around a fixed shaft 136. The bail set arm 135 includes a cam portion 135*a*, a first stepped portion 135*b* and a second stepped portion 135*c*, which are formed continuously so as to be slidingly engageable with a roller 128*a* which is rotatably mounted on a projection 128*pr* formed intermediate of the bail lever 128. The bail set arm 135 further includes an arm 135*e* which is provided at its tip end with a rotatably supported roller 135*d* engageable with the second cam portion 131*d* of the set lever 131.

The paper setting mechanism 129 of this embodiment further includes a latch lever 138 which is provided with first and second engaging portions 138*a* and 138*b* engageable with the projection 131*c* of the set lever 131. Also provided in a tension coil spring 139 having one end connected to the leftmost end of the latch lever 138 so that the latch lever 138 is spring-biased to rotate clockwise around the fixed shaft 136.

A combination of the bail set arm 135 and the latch lever 138 constitutes a latch mechanism for causing the set lever 131 to be latched in its latched position when the paper bail assembly 22' is moved into its retracted position with the bail rollers 23 separated away from the platen roller 12 as the set lever 131 is rotated in an intended direction.

Also provided is a reset arm 140 which is supported to be pivotal around the fixed shaft 136 and which has an arm 140*a* which is engageable with the top end surface of the latch lever 138. It is so structured that the reset arm 140 may pivot only in the clockwise direction as indicated by the arrow 140*ar* in FIG. 15 and the pivotal movement in the counterclockwise direction is restrained by a stopper 141. There is also provided a reset pawl 143 which is provided with teeth 143*a* engageable with the reset ratchet wheel 132 and which is pivotally supported by the reset arm 140 through a shaft 145 and biased to pivot clcokwise around the shaft 145 by means of a tension coil spring 144 extending between the shaft 25 of bail lever 128 and the leftmost end of the reset pawl 143. Here, a combination of the reset ratchet wheel 132, reset arm 140 and reset pawl 143 constitutes a latch releasing mechanism for releasing the latched condition of the set lever 131 established by the latch mechanism described previously when the platen roller 12 is driven to rotate in the reversed direction.

Also provided disposed to the right of the platen roller 12 as shown in FIG. 15 is an auto set switch 147 which is, for example, comprised of a microswitch and which is located at a position such that it becomes actuated by the first cam portion 131*b* of the set lever 131 when the set lever 131 has been rotated over a predetermined amount in the direction indicated by the arrow Q. Below the platen roller 12 is disposed a pressure release bar 148 which is pivoted counterclockwise in the direction indicated by the arrow 148*ar* by the first cam portion 131*b* of the set lever 131 when the set lever 131 is rotated in the direction indicated by the arrow P as shown, and the pressure release bar 148 is normally biased against the set lever 131 by means of a tension coil spring 149.

FIGS. 16 through 20 indicate the condition of the above-described paper setting mechanism 129 at each stage of paper setting operation, and it will be described in detail later.

Figure 21:
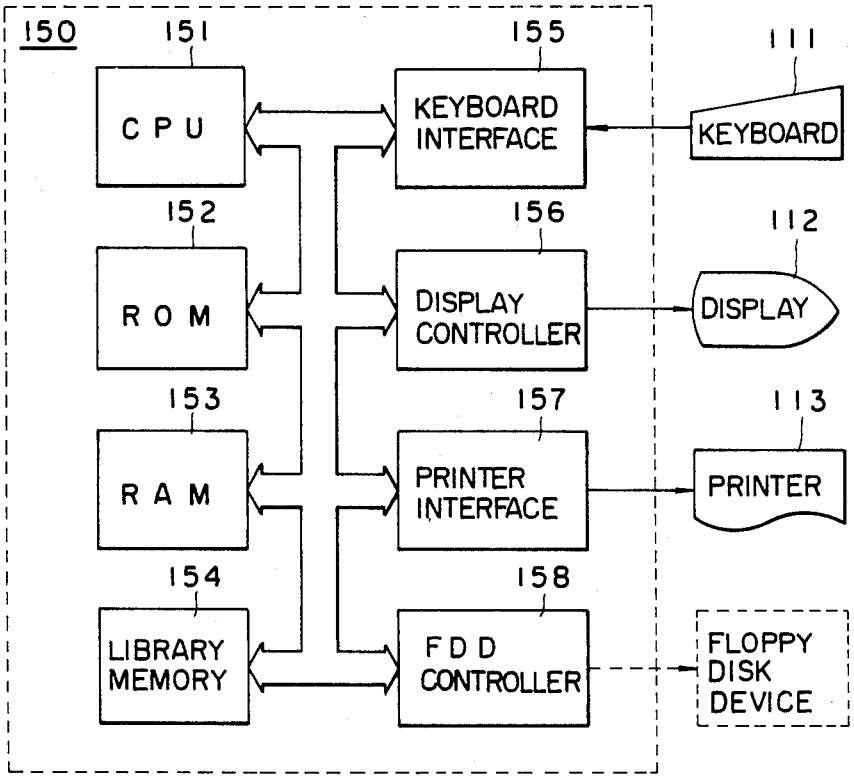
FIG. 21 is a block diagram showing a control system provided in the typewriter of FIG. 12.

FIG. 21 is a block diagram showing a print control system 150 provided in the above-described electronic typewriter. As shown, the print control system 150 includes a CPU 151, a ROM 152 and a RAM 153 serving as a memory for storing texts and text formats, which together define a microcomputer and controls the overall operation of the electronic typewriter. In addition, the print control system 150 also includes a library memory 154, a keyboard interface 155, a display controller 156, a printer interface 157 and a floppy disk controller 158 for use in interfacing with a floppy disk device FDD. It is to be noted, however, that the illustrated print control system 150 for controlling the operation of the printer section 113 of the electronic typewriter is similar in structure to the previously described print control system shown in FIG. 10 excepting that the present print control system 150 has an additional feature for selectively driving the correction mechanism to use correction tape, so that the description of each element will be omitted here.

Now, the paper setting operation in the electronic typewriter will be described. In the first place, the operation of the paper setting mechanism 129 in the above-described electronic typewriter will be described in detail with reference to FIGS. 15 through 20.

Figure 16:
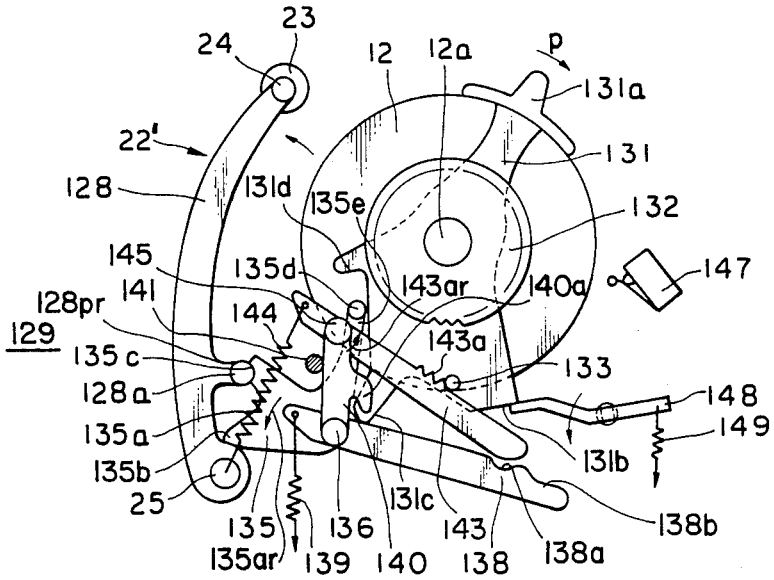
FIGS. 16 through 20 are schematic illustrations which are useful for explaining the operation of the paper setting mechanism shown in FIG. 15.

FIG. 15 indicates that the paper setting mechanism 129 is in its set condition wherein the paper bail assembly 22' keeps its bail rollers 23 pressed against the platen roller 12. Thus, when it is desired to insert a sheet of paper 12*p*, the set lever 131 is first rotated in the clockwise direction as indicated by the arrow P in FIG. 15. With this clockwise rotation of the set lever 131, the roller 135*d* mounted on the bail set arm 135 is pushed somewhat sideways by the second cam portion 131*d* of the set lever 131 as indicated in FIG. 16 so that the bail set arm 135 pivots counterclockwise as indicated by the arrow 135*ar* in FIG. 16. Following this pivotal movement of bail set arm 135, the roller 128*a* mounted on the bail lever 128 and in engagement with the detent 135*a* of bail set arm 135 is pushed to the left in FIG. 16 so that the paper bail assembly 22' is moved to its first retracted position separated away from the platen roller 12 to be retained in its position whereby the roller 128*a* mounted on the bail lever 128 is engaged with the stepped portion 135*c* of bail set arm 135. At the same time, the pressure release bar 148 is pivoted counterclockwise as indicated by the arrow 148*ar* through engagement with the first cam portion 131*b* of set lever 131 so that pressure rollers (not shown) are moved to be separated away from the platen roller 12 thereby establishing a condition in which a sheet of paper 12*p* may be inserted.

Then, in order to set the sheet of paper 12*p* in position, the set lever 131 is rotated counterclockwise as indicated by the arrow Q in FIG. 15. With this rotation of set lever 131, the roller 135d mounted on the bail set arm 135 in engagement with the second cam portion 131*d* of set lever 131 is pushed somewhat downward so that the bail set arm 135 pivots clockwise as indicated by the arrow 135*ar'* in FIG. 17*a*. Following this pivotal movement of bail set arm 135, the roller 128*a* mounted on the bail lever 128 and engaged with the detent 135*a* of bail set arm 135 is pushed generally toward the left in FIG. 17*a* so that the paper bail assembly 22' is again moved to its second retracted position separated away from the platen roller 12 with the bail rollers 23 located as separated away from the platen roller 12. In this case, when the paper bail assembly 22' is set in its second retracted position, the roller 128*a* mounted on the bail lever 128 becomes engaged with the cam portion 135*b* of bail set arm 135.

Figure 17A:
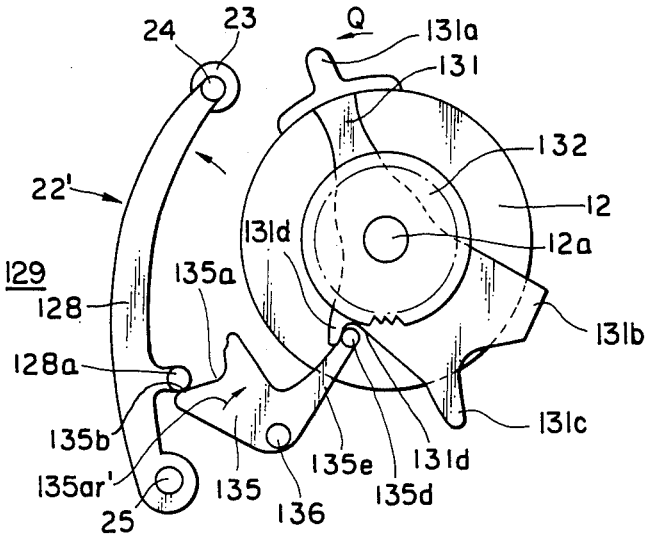
Figure 17B:
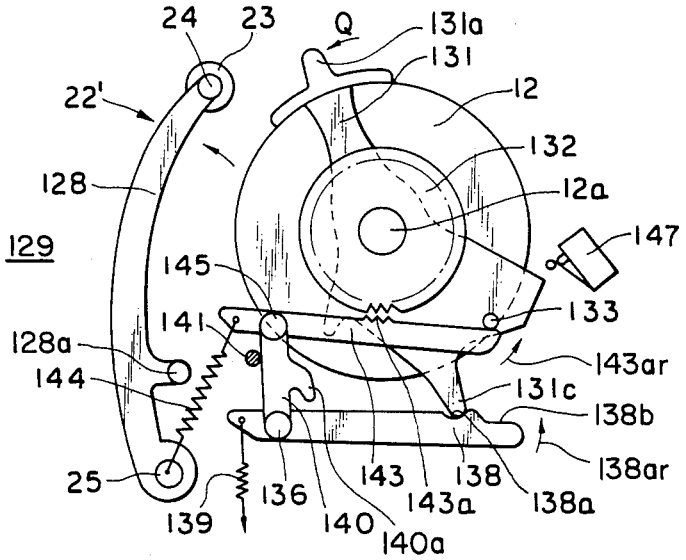

At the same time, as shown in FIG. 17*b*, since the projection 131*c* of set lever 131 moves slightly upward, the latch lever 138 pivots counter clockwise in FIG. 17*b*) as indicated by the arrow 138*ar* so that the projection 131*c* of latch lever 131 becomes engaged with the first engaging portion 138*a* of latch lever 138. As a result, the set lever 131 is retained in the current condition and thus the paper bail assembly 22' is also retained in the second retracted condition. This is because, as described with respect to the previous embodiment, the paper bail assembly 22' is temporarily held separated away from the platen roller 12 so as to allow to carry out, for example, a skew correcting operation with ease. Under this condition, no automatic paper setting operation takes place.

It is to be noted that the reset pawl 143 also pivots counter clockwise (in FIG. 17*b*) as indicated by the arrow 143*ar* following the counterclockwise rotation of the set lever 131 as indicated in FIG. 17*b*; however, since it is still in engagement with the stopper 133 mounted on the set lever 131, the teeth 143*a* formed in the rest pawl 143 still remain disengaged from the reset ratchet wheel 132. It should be noted that FIGS. 17*a* and 17*b* indicate the same condition, but they are separately shown so as to facilitate understanding of a reader.

Figure 18:
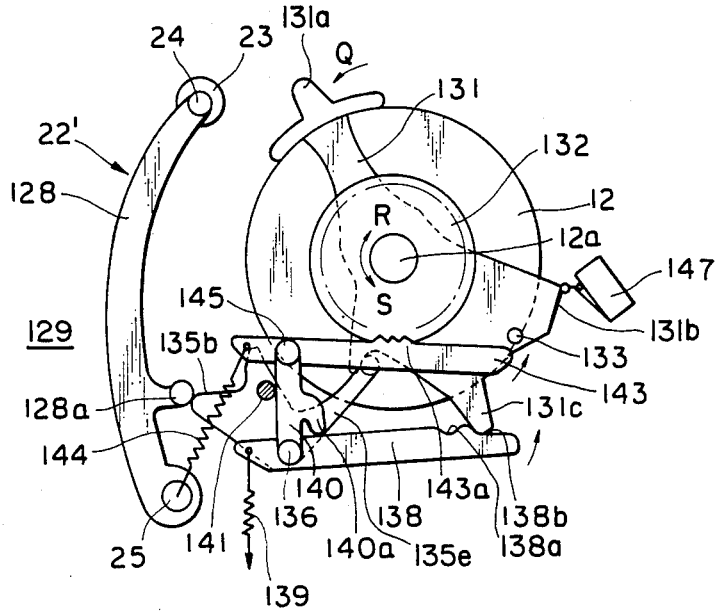

Now, if the set lever 131 is further rotated counterclockwise in the direction indicated by the arrow Q from the condition shown in FIG. 17*b*, the projection 131*c* of set lever 131 becomes disengaged from the first engaging portion 138*a* of latch lever 138 and instead becomes engaged with the second engaging portion 138*b*, as indicated in FIG. 18, so that the set lever 131 as well as the paper bail assembly 22' are temporarily retained in this condition as latched. Under the condition, the reset pawl 143 becomes disengaged from the stopper 133 of set lever so that the teeth 143*a* become engaged with the reset ratchet wheel 132 (see also FIG. 19). At the same time, the first cam portion 131*b* of set lever 131 comes into contact with the auto set switch 147 to have it actuated so that the auto set designating signal AS is supplied to the print control system 150.

Figure 19:
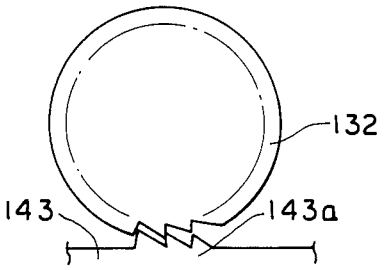

In response to this signal AS, the print control system 150 drives the line feed motor 13 thereby causing the platen roller 12 to rotate in the normal direction (line feed direction) or in the direction indicated by the arrow R in FIG. 18 over a predetermined amount, which is a sum of a first predetermined amount X and a second predetermined amount N, and, thereafter, causing the platen roller 12 to rotate in the reversed direction (back line feed direction) or in the direction indicated by the arrow S in FIG. 18 over the second predetermined amount N. In this case, since the reset ratchet 132 is fixedly attached to the shaft 12*a* of platen roller 12, it rotates together with the platen roller 12. Accordingly, when the reset ratchet 132 rotates in the normal direction (R direction), since the engagement between the reset ratchet 132 and the teeth 143*a* of reset pawl 143 is in a condition as indicated in FIG. 19, the reset pawl 143 does not follow the rotation of the reset ratchet wheel 132. Besides, the reset arm 140 does not pivot as being restrained by the stopper 141.

Figure 20:
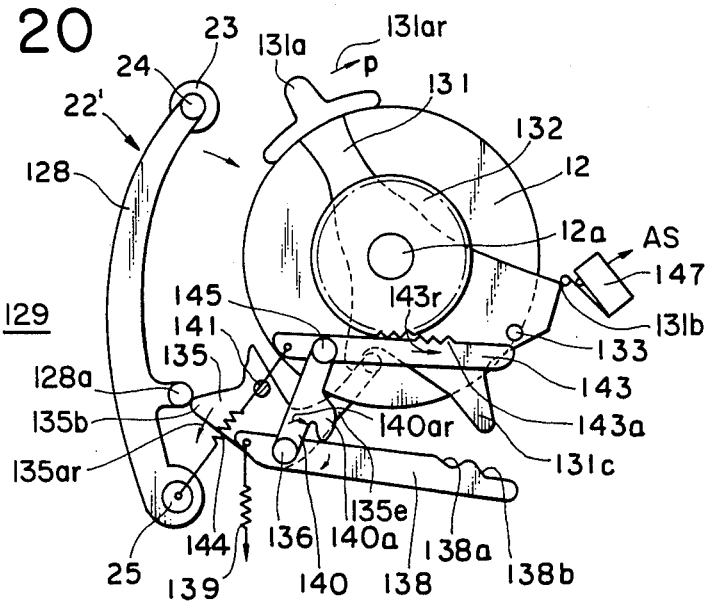

On the other hand, when the reset ratchet wheel 132 rotates in the reversed direction (S direction), the reset pawl 143 may move along with the rotation reset ratchet wheel 132 as shown in FIG. 20, and, therefore, the reset pawl 143 moves to the right as indicated by the arrow 143*r* in FIG. 20 so that the reset arm 140 pivots clockwise as indicated by the arrow 140*ar*. Thus, the latch lever 138 is forced to move downward by the arm portion 140*a* of reset arm 140, the latch lever 138 becomes disengaged from the set lever 131.

As a result, the set lever 131 is forced to rotate clockwise as indicated by the arrow 131*ar* in FIG. 20 due to the recovery force of the bail lever spring 26 and the bail set arm 135 pivots counterclockwise as also indicated by the arrow 135*ar* along therewith, which then causes the bail lever 128 to pivot clockwise toward the platen roller 12 to establish the original set condition shown in FIG. 15 with the bail roller 23 pressed against the platen roller 12.

As described above, in the present paper setting mechanism 129, the paper bail assembly 22' is once latched in a retracted position with the bail rollers 23 separated away from the platen roller 12 and then the platen roller 12 is driven to rotate first in the normal direction over a first predetermined amount X and then in the reversed direction over a second predetermined amount N, whereby the reversed rotation of the platen roller 12 is utilized to cause the paper bail assembly 22 to become unlatched.

Figure 22:
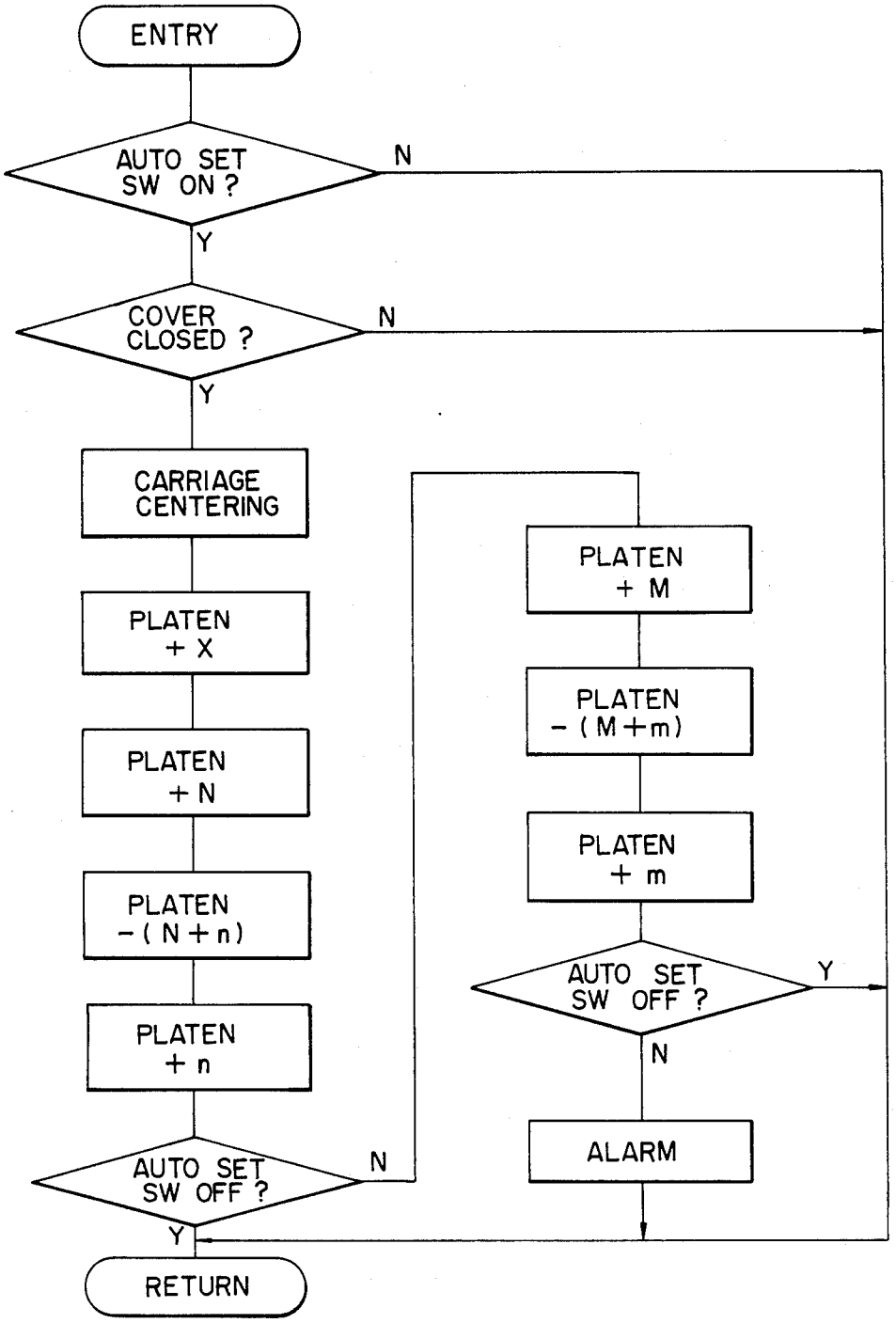
FIG. 22 is a flow chart showing a sequence of steps which are to be followed when carrying out the paper setting operation under the control of the control system shown in FIG. 21.

Now, the paper setting process to be carried out by the above-described print control system 150 will be described with reference to FIG. 22. The present paper setting process is basically similar to that of the previous embodiment shown in FIG. 11; however, since the line feed mechanism in the present embodiment is not provided with a detent lever as described before, when the platen roller 12 is driven to rotate in the reversed direction, it is so structured that the platen roller 12 is driven to rotate in the reversed direction with an extra amount of n or m (m may be equal to n) and then it is again driven to rotate in the normal direction over this amount n or m, thereby allowing to prevent an error in set position from occurring due to backlash of a gear.

In this manner, even in this electronic typewriter, the paper bail assembly 22' is temporarily latched in its retracted position separated away from the platen roller 12 and the platen roller 12 is driven to rotate first in the normal direction and then in the reversed direction whereby the paper bail assembly 22' is caused to be unlatched utilizing the reversed rotation of the platen roller 12 thereby allowing the paper bail assembly 22' to automatically return to its set position where the bail rollers 23 are pressed against the platen roller 12.

It should be noted that, in the above-described embodiments, the present invention has been applied to a type wheel printer; however, the present invention may also be applied to other types of printers, such as dot impact printers, thermal printers, thermal transfer printers and ink-jet printers. Furthermore, use has been made of a servo motor for the space motor 35 and selection motor 56 in the above-described embodiments; however, use may also be made of a stepping motor while using an encoder to define a closed loop control system or without using an encoder to define an open control system.

While the above provides a full and complete disclosure of the preferred embodiment of the present invention, various modifications, alternate constructions and equilvalents may be employed without departing from the true spirit and scope of the invention. Therefore, the above description and illustration should not be construed as limiting the scope of the invention, which is defined by the appended claims.

What is claimed is:

1. Apparatus for setting a sheet of paper in position around a rotatably supported platen roller, comprising:

a rotatably supported platen roller;

driving means for rotating said platen roller;

a paper bail assembly including at least one bail roller, said paper bail assembly being pivotally supported and capable of taking a set position where said bail roller is pressed against said platen roller, a first retracted position wherein said bail roller is separated away from said platen roller and a second retracted position where said bail roller is further separated away from said platen roller, said paper bail assembly being normally biased toward said set position;

position control means for controlling the position of said paper bail assembly, said position control means being operatively coupled to said paper bail assembly and said platen roller and temporarily holding said paper bail assembly in said first or second retracted position when said paper bail assembly is manually moved thereto;

detecting means for detecting said paper bail assembly when said paper bail assembly is manually moved to said second retracted position, and for generating a detection signal in response to detecting that the paper bail assembly is at said second retracted position; and drive control means for controlling said driving means, said drive control means being responsive to said detection signal from said detecting means to cause said driving means to rotate said platen roller first in a normal direction over a first predetermined amount and then in a reverse direction over a second predetermined amount, wherein said rotation of said platen roller in the reversed direction causes said paper bail assembly to return to said set position through an automatic interaction with said position control means.

2. The apparatus of claim 1 wherein said paper bail assembly includes a pair of bail levers, each having a pivotally supported base end, which are spaced apart along the longitudinal direction of said platen roller, a bail rod extending between said pair of bail levers at free ends thereof and said at least one bail roller rotatably supported by said bail rod.

3. The apparatus of claim 2 wherein said platen roller is integrally provided with a ratchet wheel and said position control means includes a latch lever which is pivotally supported and which has a first end engageable with said ratchet wheel and a second end having a first engaging portion and a second engaging portion which may be brought into engagement with said paper bail assembly selectively, whereby said paper bail assembly is held in said first retracted position when said paper bail assembly is engaged with said first engaging portion of said latch lever.

4. The apparatus of claim 3 wherein when said paper bail assembly is manually operated so as to engage with said second engaging portion of said latch lever, said detecting means supplies said detection signal and said first end of said latch lever becomes engaged with said ratchet wheel thereby causing said latch lever to be disengaged from either of said first and second engaging portions when said platen roller is driven to rotate in said reversed direction and to bring said paper bail assembly into said set position.

5. The apparatus of claim 4 wherein said detecting means includes an auto set switch and said paper bail assembly includes an integrally formed arm which comes into contact with said switch to have said switch actuated when said paper bail assembly is operated to be brought into engagement with said second engaging portion of said latch lever.

6. The apparatus of claim 2 further comprising a manually operable and rotatably supported set lever which is operatively coupled to said position control means, whereby said set lever may take a first position wherein said paper bail assembly takes said set position and said set lever may take a second position as rotated in a predetermined direction from said first position wherein said paper bail assembly is moved to said first retracted position through said position control means

7. The apparatus of claim 6 wherein said detecting means includes a switch which is so disposed that said set lever comes into contact with said switch to have said switch actuated thereby supplying said detection signal when said set lever is rotated further in said predetermined direction over a predetermined amount from said second position.

* * * * *